US006966869B1

(12) United States Patent
Stearns et al.

(10) Patent No.: US 6,966,869 B1
(45) Date of Patent: Nov. 22, 2005

(54) EXERCISE METHODS AND APPARATUS WITH ELLIPTICAL FOOT MOTION

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 10/876,244

(22) Filed: Jun. 23, 2004

Related U.S. Application Data

(60) Provisional application No. 60/483,510, filed on Jun. 26, 2003.

(51) Int. Cl.[7] ..... A63B 69/16; A63B 22/04
(52) U.S. Cl. ..... 482/52; 482/57
(58) Field of Search ..... 482/51–53, 57, 482/70, 79–80

(56) References Cited

U.S. PATENT DOCUMENTS

| | | | | |
|---|---|---|---|---|
| 5,766,113 | A * | 6/1998 | Rodgers, Jr. | 482/52 |
| 5,788,610 | A * | 8/1998 | Eschenbach | 482/52 |
| 5,924,963 | A * | 7/1999 | Maresh et al. | 482/57 |
| 6,120,417 | A * | 9/2000 | Johnston | 482/57 |
| 6,802,797 | B2 * | 10/2004 | Maresh | 482/57 |
| 6,855,094 | B1 * | 2/2005 | Maresh | 482/52 |

* cited by examiner

*Primary Examiner*—Stephen R. Crow

(57) ABSTRACT

An exercise device has left and right foot supports that are pivotally connected to respective pairs of pivoting rocker arms, which in turn, are pivotally connected to respective skates. Left and right cranks move the skates along a frame, and move the foot supports relative to the skates in a manner that defines adjacent paths of generally elliptical foot motion, while maintaining the foot supports in a fixed orientation relative to the frame.

3 Claims, 2 Drawing Sheets

Figure 1:
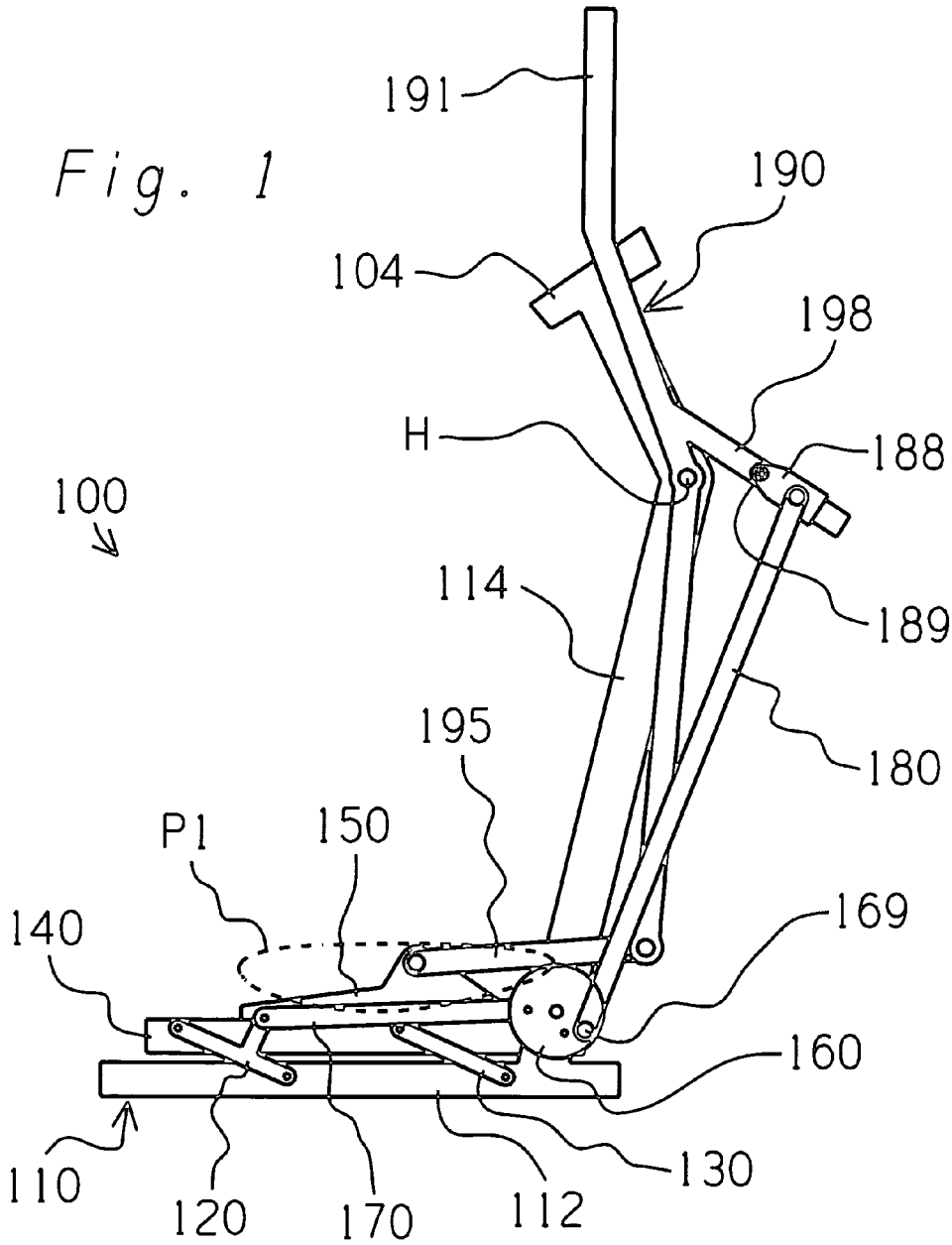

191
190
104
198
H
188
100
114
189
195
180
P1
150
140
169
160
110
120
170
112
130

EXERCISE METHODS AND APPARATUS WITH ELLIPTICAL FOOT MOTION

CROSS-REFERENCE TO RELATED APPLICATION

Disclosed herein is material that is entitled to the filing date of U.S. Provisional No. 60/483,510, filed on Jun. 26, 2003.

FIELD OF THE INVENTION

The present invention relates to exercise methods and apparatus, and more specifically, to machines that guide a person's feet through elliptical paths.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses a linkage assembly to convert a relatively simple motion, such as circular, into a relatively more complex motion, such as elliptical. For example, see U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; and U.S. Pat. No. 5,882,281 to Stearns et al.

The foregoing examples of elliptical exercise equipment have foot supports that change orientation during exercise activity. To the contrary, an object of the present invention is to facilitate elliptical foot motion in a manner that maintains the foot supports in a constant orientation.

SUMMARY OF THE INVENTION

Generally speaking, the present invention provides a novel linkage assembly and corresponding exercise apparatus suitable for generating generally elliptical foot motion. The present invention may be described in terms of an exercise apparatus having left and right skates movably mounted on a frame and constrained to remain in fixed orientations relative to the frame. Pairs of left and right rocker arms are pivotally interconnected between respective skates and respective foot supports in a manner that maintains the foot supports in fixed orientations relative to respective skates. Left and right cranks are connected to respective skates and respective foot supports in a manner that moves both the skates relative to the frame and the foot supports relative to respective skates (while maintaining the foot supports in a constant orientation relative to the frame). Many features and advantages of the present invention will become apparent to those skilled in the art from the more detailed description that follows.

BRIEF DESCRIPTION OF THE FIGURE OF THE DRAWING

Figure 2:
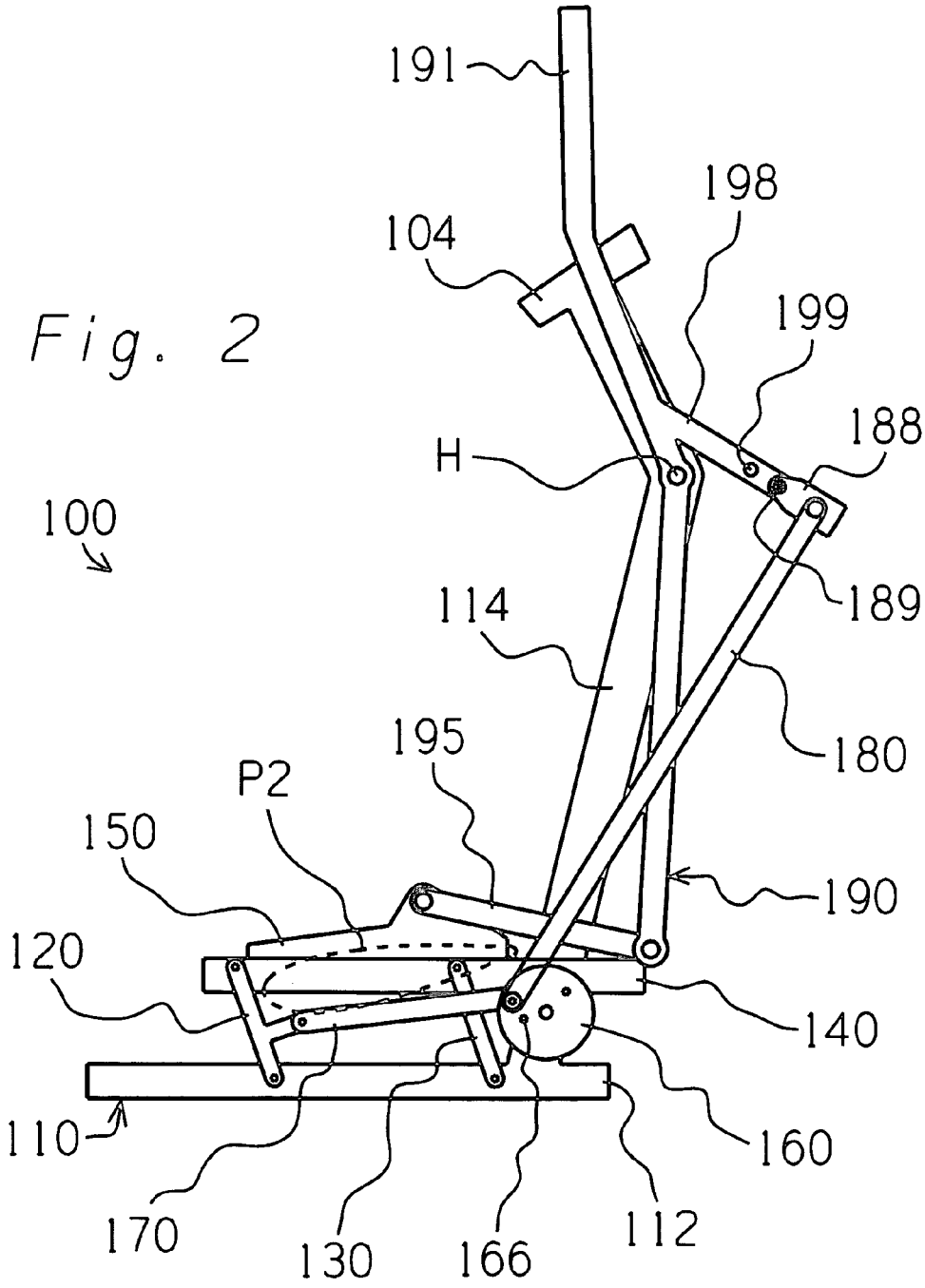

With reference to the Figures of the Drawing, wherein like numerals represent like parts and assemblies throughout the several views, FIG. 1 is a side view of a first elliptical motion exercise device constructed according to the principles of the present invention, showing the frame and the near side of a linkage assembly movably mounted on the frame; and FIG. 2 is a side view of a second elliptical motion exercise device constructed according to the principles of the present invention, showing the frame and the near side of a linkage assembly movably mounted on the frame.

DETAILED DESCRIPTION OF A PREFERRED EMBODIMENT

A first exercise machine constructed according to the principles of the present invention is designated as 100 in FIG. 1. The exercise machine 100 generally includes a frame 110; left and right linkage assemblies movably mounted on the frame 110; and a user interface 104 mounted on the frame 110. The interface 104 may be designed to perform a variety of functions, including (1) displaying information to the user such as (a) exercise parameters and/or programs, (b) current parameters and/or a currently selected program, (c) current time, (d) elapsed exercise time, (e) current speed of exercise, (f) average speed of exercise, (g) calories burned during exercise, (h) simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the orientation of the exercise motion, and/or (f) quickly stop the exercise motion.

The machine 100 is generally symmetrical about a vertical plane extending lengthwise through the center of the frame 110. For ease of illustration, FIG. 1 shows only the right side linkage assembly, with the understanding that a similar left side linkage assembly is disposed on the left side of the machine (preferably one hundred and eighty degrees out of phase relative to the right side). Also, to the extent that reference is made to forward or rearward portions of a machine 100, it is to be understood that a person could exercise while facing in either such direction relative to the disclosed linkage assembly. This understanding is supported by the depiction of an essentially "reversed" second embodiment 200 depicted in FIG. 2.

With reference back to FIG. 1, the frame 110 includes a floor engaging base 112 that defines left and right tracks 115. Also, a forward stanchion 114 extends upward from the base 112 proximate the front end of the frame 110. An upper end of the forward stanchion 114 is configured to support the user interface 104, and may be configured to support additional items, including a water bottle, for example.

On each side of the machine 100, a skate 150 is movably mounted on a respective track 115 (preferably by means of rollers or bearings that facilitate a smooth gliding interface therebetween). On the machine 100, for example, each skate 150 has front and rear rollers that are constrained to roll along a respective track 115, and that constrain the skate 150 to remain in a fixed orientation relative to the track 115.

On each side of the machine 100, first and second rocker arms 120 and 130 have lower ends that are pivotally connected to a respective skate 150, thereby defining first and second lower pivot axes. Opposite, upper ends of the rocker arms 120 and 130 are pivotally connected to a respective foot support 140, thereby defining first and second upper pivot axes. The distance between the two upper pivot axes is equal to the distance between the two lower pivot axes, and the distance between the two pivot axes associated with the first rocker arm 120 is equal to the distance between the two pivot axes associated with the second rocker arm 130. In other words, the rocker arms 120 and 130 cooperate with respective foot supports 140 and respective skates 150 to define four bar linkages having opposing links that remain parallel to one another. As a result, the foot supports 140 are constrained to move through respective arcuate paths relative to the skates 150 while remaining in a fixed orientation relative to the frame 110.

On each side of the machine 100, a crank 160 is rotatably mounted on the frame 110 at or near the forward stanchion 114. Each crank 160 may be described in terms of a first effective crank arm that is pivotally connected to the forward end of a first drawbar link 170, and a second effective crank arm that is pivotally connected to the forward end of a second drawbar link 180. A crank link 166 has a first end that is rigidly connected to the crank 160 at the first crank arm, and an opposite, second end that defines the second crank arm at an axially outboard location relative to the first crank arm.

An opposite, rearward end of each first drawbar 170 link is pivotally connected to a portion of a respective four bar linkage that moves relative to a respective skate 150 (in this case, an intermediate portion of the forward rocker arm 130). In other words, the first drawbar links 170 link rotation of respective cranks 160 to pivoting of respective foot supports 1400, and/or may be described as means for moving respective foot supports 140 relative to respective skates 150.

An opposite, rearward end of each second drawbar link 180 is pivotally connected to a respective skate 150. In other words, the second drawbar links 180 link rotation of respective cranks 160 to movement of respective skates 150 along respective tracks 115, and/or may be described as means for moving respective skates 150 relative to the frame 110.

Left and right handlebar rocker links 190 have intermediate portions that are pivotally mounted on respective sides of the stanchion 114 at a common pivot axis H. An upper end 191 of each handlebar rocker link 190 is sized and configured for grasping. An opposite, lower end of each handlebar rocker link 190 is pivotally connected to a forward end of a respective intermediate link 197. An opposite, rearward end of each intermediate link 197 is pivotally connected to a respective skate 150 (at the same location as the second drawbar link 180). As a result of this arrangement, rotation of the cranks 160 is linked to pivoting of the handles 191, as well as movement of the skates 150 and foot supports 140.

Other means for moving the skates 150 along the tracks 115 may be substituted for the foregoing arrangement. For example, substitute second drawbar links may be operatively connected to respective handlebar rocker links 190, rather than directly connected to the skates 150. The length of the resulting foot path may then be adjusted, if desired, by varying the effective moment arm of the second drawbar links relative to the pivot axis H. Generally speaking, the smaller this moment arm the effective crank radius on this alternative embodiment, the greater the horizontal displacement of the foot supports 140.

The combined movements of the skates 150 relative to the frame 110, and the foot supports 140 relative to the skates 150 results in a generally elliptical path of motion P for the foot supports 140 relative to the frame 110. As used herein, the term "elliptical" is intended in a broad sense to describe a closed path having a relatively longer, major axis and a relatively shorter, minor axis (which extends perpendicular to the major axis).

The machine 100 may be considered advantageous to the extent that both the footprint of the machine 100 and the space needed for its operation are relatively small in comparison to the available stride length; the stride length is not necessarily limited by the diameter or stroke of the cranks (if handlebar amplification is implemented, for example); and/or the foot supports 140 may be positioned in close proximity to one another, thereby accommodating foot motion which may be considered a better approximation of real life activity. In this regard, the positions of the foot supports 140 (above the skates 150) eliminate the need for a frame supported bearing assembly between the foot supports 140.

FIG. 2 shows a second a second exercise machine 200 constructed according to the principles of the present invention. As suggested by the common reference numerals (and as noted above), the machine 100 is similar in many respects to the first machine 100, with the primary difference being that a person is encouraged to face in the opposite direction relative to the linkage assemblies.

The machine 200 includes a frame 210 having a floor engaging base 212 that defines left and right tracks 215; a forward stanchion 214 similar to the stanchion 114 and supporting an identical user interface 104; and a rearward stanchion 216 that supports left and right cranks 160. Identical skates 150 are rollably mounted on respective tracks 215, and identical rocker arms 120 and 130 are pivotally connected to respective skates 150. Slightly modified foot supports 240 are pivotally connected to respective rocker arms 120 and 130 to accommodate a person's feet forward of the cranks 160. Identical drawbar links 170 and 180 are interconnected between the cranks 160 and the four bar linkages defined by the skates 150, the rocker arms 120 and 130, and the foot supports 140.

The present invention has been described with reference to preferred embodiments that will enable persons skilled in the art to recognize additional embodiments and/or applications which incorporate the essence of the present invention. Those skilled in the art will also recognize that the preferred embodiments may be modified in various ways without departing from the scope of the present invention. For example, various inertia altering devices, including a flywheel and/or resistance mechanisms may be added to the machines. Also, various linkage arrangements may be used to move the skates relative to the frame and/or the foot supports relative to the skates. With the foregoing in mind, the scope of the present invention is to be limited only to the extent of the following claims.

What is claimed is:

1. An exercise device, comprising:

a frame configured to rest on a floor surface;

a left skate movably mounted on the frame;

first and second left rocker arms pivotally connected to the left skate;

a left foot support pivotally connected to the left rocker arms to define a left four bar linkage that maintains the left skate in a fixed orientation relative to the frame;

a right skate movably mounted on the frame;

first and second right rocker arms pivotally connected to the right skate;

a right foot support pivotally connected to the right rocker arms to define a right four bar linkage that maintains the right skate in a fixed orientation relative to the frame;

a left crank and a right crank, wherein each said crank is rotatably mounted on the frame;

left and right first moving means interconnected between a respective said crank and a portion of a respective said four bar linkage that moves relative to a respective said skate, for moving a respective said foot support relative to a respective said skate; and left and right second moving means interconnected between a respective said crank and a respective said skate, for moving the respective said skate relative to the frame.

2. The exercise device of claim 1, wherein each said first moving means includes at least one rigid link pivotally interconnected between a respective said crank and a respective said portion.

3. The exercise device of claim 1, wherein each said second moving means includes at least one rigid link pivotally interconnected between a respective said crank and a respective said skate.

* * * * *